US008506192B2

(12) United States Patent
Allbritton

(10) Patent No.: US 8,506,192 B2
(45) Date of Patent: Aug. 13, 2013

(54) DENTAL HYGIENIC KIT

(75) Inventor: Deborah Maria Allbritton, Villa Rica, GA (US)

(73) Assignee: Perfect Paste LLC, Atlanta, GA (US)

( * ) Notice: Subject to any disclaimer, the term of this patent is extended or adjusted under 35 U.S.C. 154(b) by 61 days.

(21) Appl. No.: 13/373,257

(22) Filed: Nov. 9, 2011

(65) Prior Publication Data

US 2013/0112591 A1 May 9, 2013

(51) Int. Cl.
*A46B 11/00* (2006.01)

(52) U.S. Cl.
USPC ..... 401/129; 401/126; 401/183

(58) Field of Classification Search
USPC ..... 401/126–130, 183–186
See application file for complete search history.

(56) References Cited

U.S. PATENT DOCUMENTS

| | | | | |
|---|---|---|---|---|
| 1,062,961 | A | 5/1913 | Funcke | |
| 1,473,766 | A | 5/1922 | Healy | |
| 1,659,628 | A | 3/1927 | Greenblatt | |
| 3,574,647 | A | 4/1971 | Flank et al. | |
| 3,574,879 | A | 4/1971 | Werding | |
| 4,403,624 | A | 9/1983 | Montgomery | |
| 4,527,574 | A | 7/1985 | Manfredi | |
| 5,040,553 | A | 8/1991 | London et al. | |
| 5,044,386 | A | 9/1991 | Nelson | |
| 5,357,647 | A | 10/1994 | Gueret | |
| 5,388,599 | A | 2/1995 | Yen | |
| 6,210,060 | B1 | 4/2001 | Gueret | |
| 6,325,076 | B1 | 12/2001 | Ramirez | |
| 6,572,296 | B2 * | 6/2003 | Schrepf | 401/122 |
| 6,702,113 | B2 | 3/2004 | Marino | |
| 7,156,107 | B2 | 1/2007 | Hsu | |
| 7,267,126 | B1 | 9/2007 | Banegas | |
| 7,398,898 | B2 * | 7/2008 | Bouix et al. | 222/183 |
| 2002/0088473 | A1 | 7/2002 | Fonseca | |

* cited by examiner

*Primary Examiner* — David Walczak
(74) *Attorney, Agent, or Firm* — Dilworth IP LLC

(57) ABSTRACT

An improved dental hygienic kit for use in brushing teeth which includes a flexible body element containing toothpaste, and a diameter restrictor that is engageable with an accompanying ergonomically-shaped toothbrush element to meter a suitable quantity of toothpaste thereon upon withdrawal of the toothbrush from the flexible body element, to ensure minimal toothpaste waste and spillage which is unique and non obvious.

8 Claims, 3 Drawing Sheets

DENTAL HYGIENIC KIT

PRIORITY CLAIM

This application does not claim priority to any previously filed application.

TECHNICAL FIELD

The present application relates generally to portable dental hygienic kits and, more particularly, to an improved dental hygienic kit with a flexible body which is preferably disposable.

BACKGROUND

Dental hygienic kits are known in the art, and are frequently used by individuals who are on the go. New travel rules and regulations regarding the limitation of quantity of liquids and liquid-like substances (e.g., pastes) that can be transported have been implemented in the travel industry. Furthermore, children can have short and limited attention spans when it comes to dental hygiene and the associated, and thus may need something creative, fun and unique to attract their attention. As such, a need exists in the art to provide an improved portable dental hygienic kit that is inexpensive, flexible, efficient, convenient, disposable and fun to use.

In the prior such art devices, dental hygienic kits typically consist of non-disposable, hard containers, with a 360 degree bristle mascara-like toothbrush and having refillable toothpaste. There are numerous problems associated therewith. For example, the non-disposable assembly is generally expensive (due in part to its non-disposable components). The container wherein the toothbrush is disposed is firm, rigid, and non-flexible and as such cannot be manipulated (leaving wasted tooth paste disposed therein). The non-disposable hard prior art containers for dental hygienic kits are small and frequently require constant refilling (which is messy and inconvenient). Furthermore, the 360 degree "mascara like" brush is ineffective and causes irritation to the interior surface of a user's lips.

Accordingly, it would be desirable and advantageous to provide an improved dental hygienic kit.

SUMMARY

In one aspect of the present invention, the improved dental hygienic kits include a new and innovative flexible body element that defines a portion of the exterior of the dental hygienic kit and functions to facilitate bending and twisting of the flexible body element to minimize content (i.e., toothpaste) waste. The dental hygienic kit of the present invention is also enjoyable to use due to its unique design and the potential customization aspects associated therewith.

The improved dental hygienic kit hereof includes a removable brush-bearing element (i.e., a bristle brush with grippable handle means connected thereto), a sealing element, and a flexible body element. A brush having bristles is provided for removable use operatively connected to the grippable handle means thereby defining a "brush-bearing element" for insertion and removal into the flexible body element.

The flexible body element forms the receptacle for storing and dispensing a measured quantity of toothpaste (or other similar cleaning paste/liquid substances) within the flexible body element. The flexible body element has flexible walls, a closed bottom, and a substantially rigid, closable top with an aperture including a sealing element for mating engagement with said brush-bearing element. Furthermore, the flexible body element includes a diameter restrictor disposed adjacent to the end of the flexible body element internally for insertion within and withdrawal therefrom of the brush-bearing element to retain thereon a measured quantity of toothpaste.

The preferred functionality of the inventive dental hygienic kit is to be disposable in nature. Therefore, the flexible body element can be provided in various lengths, depending on the user's needs and the length of the brush-bearing element. The flexible body element of the preferred embodiment is of a size that can hold an approved measured quantity of toothpaste (as defined according to TSA regulations).

The sealing element has female/male threaded components disposed directly on the brush-bearing element and on the aperture end of the flexible body element. Specifically, the flexible body element is longitudinally disposed from said brush-bearing element on said removable toothbrush and disposed circumferentially therearound for mating engagement with said flexible body element sealing element. The sealing element thereby convertibly seals the toothpaste contents disposed within the flexible body element and helps to prevent drying out, while providing access to the toothpaste contents upon removal therefrom of said toothbrush.

The male and female threaded components can be interchanged on and between (1) the brush-bearing element; and (2) the flexible body element—depending on the design and the user's needs. For example, the brush-bearing element can have the male threaded component and the flexible body element can have the female component. The sealing element has numerous purposes associated therewith including maintaining an air seal (i.e., between the flexible body element and the brush-bearing element) to avoid toothpaste spoilage, and the facilitation of the removal of excess toothpaste from the inserted brush-bearing element when removed from the flexible body element.

It is also contemplated that the sealing element has a locking element associated therewith. Specifically, the sealing mechanism locks the brush-bearing element into place when closed—to prevent spillage of toothpaste (i.e., similar to automotive gas cap technology with a twisting locking mechanism—and thus to prevent spillage and to be air tight).

In such preferred embodiments, the bristles of the brush preferably extend outwardly in a substantially single radial direction for operational use in the brushing of the teeth, while materially avoiding engagement with the inner surface of the lips, so as to assure complete and effective cleaning thereof. The bristles of the toothbrush can be in various lengths and sizes to facilitate the use thereof, as preferred by the user.

The grippable handle means preferably can be cylindrical, or round in shape, or other conveniently grippable shapes. A cap-like grippable handle means is also contemplated in such preferred embodiments. Furthermore, it is alternatively contemplated that the grippable handle means can be long and thin similar to the traditional toothbrush design known in the art.

The flexible body element is designed to be squeezed and manipulated by a user. After some use of the contents (i.e., toothpaste), the user can roll up the flexible body element up, similar to the traditionally known ways involving toothpaste tubes. Also, a twist tie mechanism is further contemplated to retain the flexible body element in proximal vicinity to and in contact with the bristle brush element for utilization of the remaining toothpaste.

It is also contemplated that the grippable handle means can be formed in various shapes, colors and have various prints or designs disposed thereon depending on the target audience. For example, the grippable handle means may be provided in the shape of the head of a child's favorite animal. In preferred embodiments, the grippable handle means has rubber grips disposed therearound to prevent slippage when handling. It is also contemplated that the flexible body element may have various colors and various prints disposed thereon. Some examples include sporting team prints, children's prints, animal prints, patter, or number prints, etc. The printing of images and colors on the flexible body element and/or on the grippable handle means makes the dental hygienic kit entertaining to use for all ages.

Moreover, the dental hygienic kit can be used by young children as a learning tool on the appropriate amount of toothpaste to use when brushing their teeth. The dental hygienic kit also reduces the waste and mess that can be caused by the use of toothpaste.

In such preferred embodiments, the flexible body element is most preferably made from a non-corrosive plastic material. And, it is also contemplated that the flexible body element is to be formed from a non-corrosive metal.

DETAILED DESCRIPTION

Figure 1:
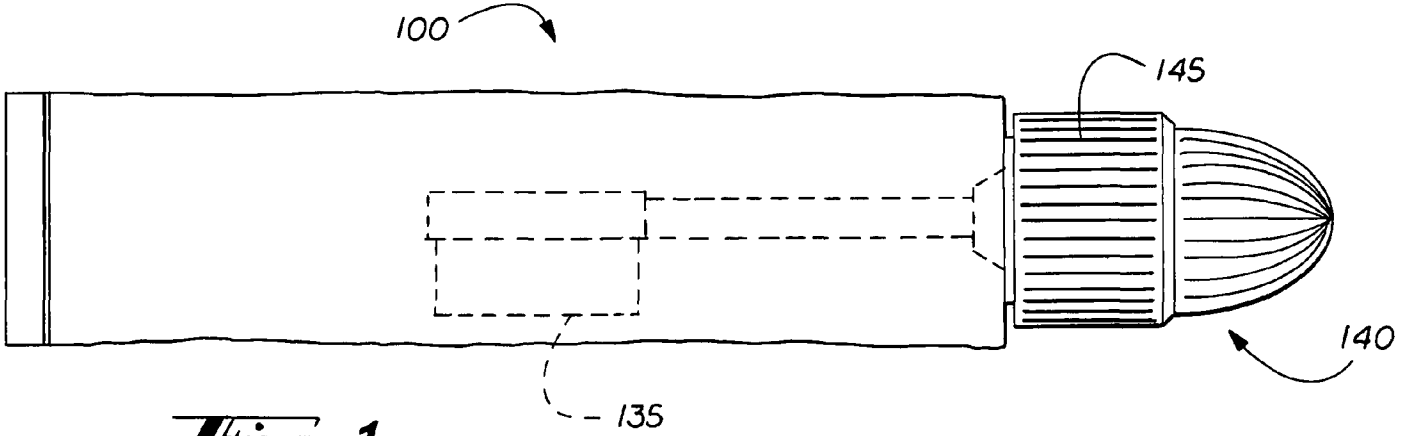
FIG. 1 is a longitudinal cross-sectional view of the improved dental hygiene kit in storage mode.

Referring to FIG. 1, a longitudinal cross-sectional view of the improved dental hygiene kit in storage mode is depicted. The exterior of improved dental hygienic kit 100 is shown.

Figure 2:
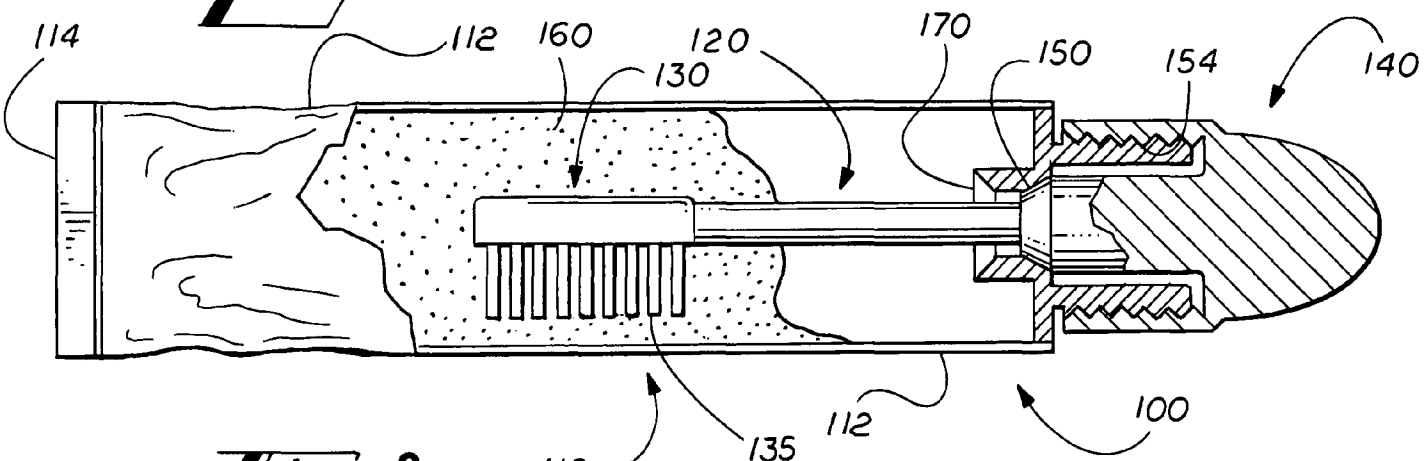
FIG. 2 is a longitudinal cross-sectional view of the improved dental hygienic kit in storage mode.

Referring to FIG. 2, a longitudinal cross-sectional view of the improved dental hygiene kit in storage mode is depicted. The improved dental hygienic kit 100 is formed by flexible body element 110 and brush-bearing element 120. Flexible body element 110 is for storing and dispensing a measured quantity of toothpaste 160, and brush-bearing element 120 having removable bristle brush 130 disposed within flexible body element 110 is for use to clean a user's teeth and mouth. Flexible body element 110 comprises flexible walls 112, closed bottom 114, and a substantially rigid, closable top 116, with aperture 180 including sealing element 150 for mating engagement with brush-bearing element 120. Closed bottom 114 of flexible body element 110 preferably comprises a substantially flat seal. Flexible body element 110 is preferably elongated in shape, and preferably cylindrical in shape. As shown in the Figs. hereof, flexible body element 110 is preferably composed of a flexible plastic material. Metals and other similar flexible materials known in the art may be substituted as the material for forming flexible body element 110.

Brush-bearing element 120 comprises grippable handle means 140 disposed at the one end thereof for manually gripping and controlling use of brush-bearing element 120. Grippable handle means 140 further has handle grips 145 for traction purposes when a user handles brush-bearing element 120. Brush-bearing element 120 comprises bristle brush 130, and is operatively connected to grippable handle means 140 with bristles 135 disposed at the opposite end thereof and extending outwardly therefrom in a substantially single radial direction for operational use in the brushing of a users teeth while materially avoiding engagement with the inner surface of the lips. Other similarly functional formats are set forth in other embodiments. Grippable handle means 140 of improved dental hygienic kit 100 preferably is substantially larger in diameter than brush-bearing element 120, for ease of use.

Improved dental hygienic kit 100 further has sealing element 150 longitudinally disposed from brush-bearing element 120 on bristle brush 130 and disposed circumferentially therearound for mating engagement with flexible body element 110, thereby convertibly to seal toothpaste 160 of flexible body element 110 from drying out, while simultaneously providing access to toothpaste 160 upon removal therefrom of said toothbrush. Sealing element 150 of improved dental hygienic kit 100 further comprises a grippable cap for flexible body element 110 and thereby is unitarily formed with grippable handle means 140.

Figure 3:
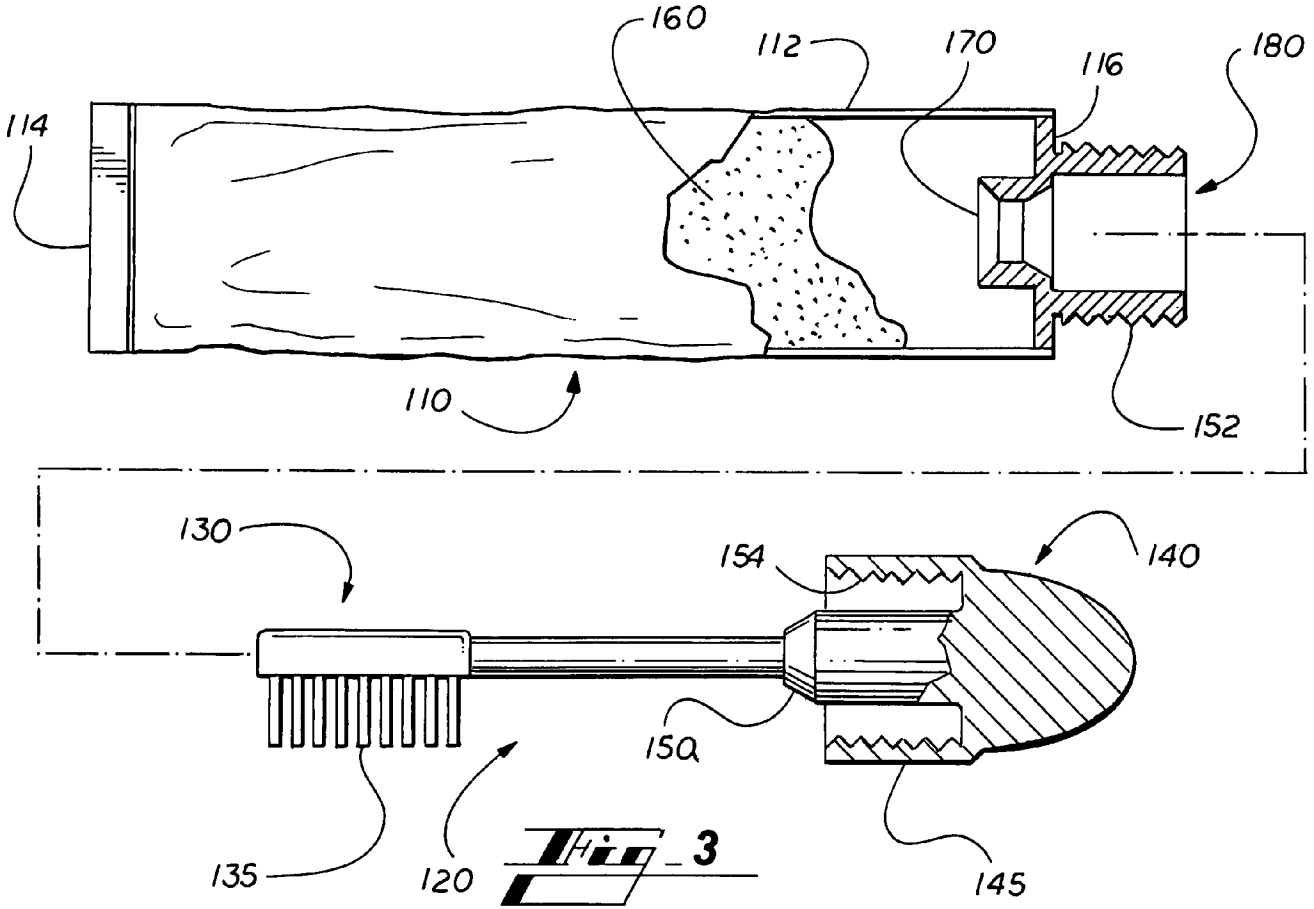
FIG. 3 is a longitudinal cross-sectional view of the improved dental hygienic kit in use mode.

Referring to FIG. 3, a longitudinal cross sectional view of the improved dental hygienic kit in use mode is depicted. Sealing element 150 further comprises operationally engageable male thread element 152 and female thread element 154. Male thread element 152 is disposed on flexible body element 110. Female thread element 154 is disposed within grippable handle means 140 of brush-bearing element 120. It is further contemplated that male thread element 152 is disposed on brush-bearing element 120 and female thread element 154 is disposed interiorly within flexible body element 110.

Flexible body element 110 further comprises diameter restrictor 170 disposed internally of flexible body element 110 and sealing element 150 for insertion of bristle brush 130 within and withdrawal therefrom of brush-bearing element 120 to retain thereon a measured quantity of toothpaste.

Figures 4, 5, 6:
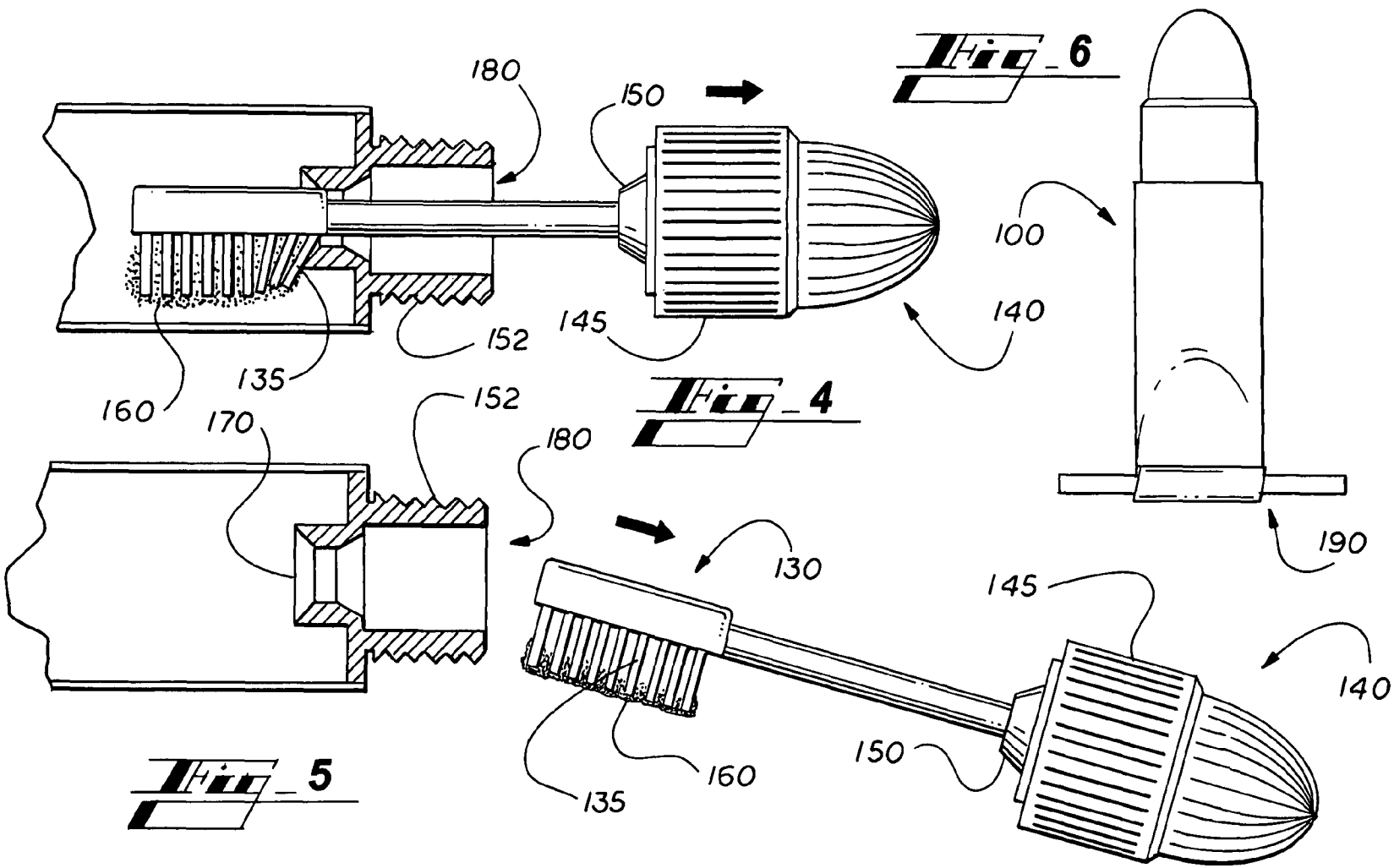
FIG. 4 is a fragmented cross sectional view of the improved dental hygienic kit showing the brush-bearing element being removed.
FIG. 5 is a fragmented cross sectional view of the improved dental hygienic kit showing the brush-bearing element removed.
FIG. 6 is a perspective view of an alternate embodiment of the flexible body element of the improved dental hygienic kit.

Referring to FIG. 4, a fragmented cross sectional view of the improved dental hygienic kit in use showing the brush bearing element being removed is depicted. When purchased, dental hygienic kit 100 has a predetermined amount of toothpaste 160 disposed within flexible body element 110. Dental hygienic kit 100 comes in stored form as shown in FIGS. 1 and 2. To use, a user suitably manipulates flexible body element 110 to ensure that toothpaste 160 is in contact with bristles 135 on bristle brush 130. The user then grasps grippable handle means 140 of brush-bearing element 120 and unscrews brush-bearing element 120 in a counter-clockwise direction, thus unlocking brush-bearing element 120 from flexible body element 110. The user then proceeds to pull brush-bearing element 120 in an outward direction from flexible body element 110. Bristle brush 130 having toothpaste 160 passes outwardly through diameter restrictor 170 and exits aperture 180. Diameter restrictor 170 is formed in selected size and shape to leave a residue desired and thusly a metered amount of toothpaste 160 on bristles 135 of bristle brush 130. Now that brush-bearing element 120 having a desired amount of toothpaste 160, has exited flexible body element 110, the brush-bearing element 120 is ready for hygienic use.

Referring to FIG. 5, a fragmented cross sectional view of the improved dental hygienic kit showing the brush bearing element removed is depicted. Specifically, the drawing shows brush-bearing element 120 having a metered amount of toothpaste 160 removed from flexible body element 110. A user can now brush his/her teeth with bristles 135 having a metered amount of toothpaste 160 in direct contact with the user's teeth. Bristles 135 formed in appropriate size, shape and disposition to avoid substantial contact with a user's mouth interior including the inner lip surfaces, to reduce material irritation and bleeding.

Once a user is finished brushing his/her teeth, brush-bearing element 120 is rinsed, shaken dry and inserted back into flexible body element 110. Once inserted, the user twists the grippable handle means 140 of brush-bearing element 120 to lock firmly into place for storage. The improved dental hygienic kit 100 is thusly disposable and inexpensive. Toothpaste 160 preferably further has a disinfectant property associated therewith to allow multiple uses without the fear of bacterial growth and potential infection.

FIG. 6 is a perspective view of an alternate embodiment of the flexible body element of the improved dental hygienic kit. Specifically, in this alternate embodiment, flexible body element 110 further has twist-tie mechanism 190, which allows a user to roll up flexible body element 110 and then to tie closed the rolled portion of flexible body element 110 to facilitate use of substantially the entire amount of toothpaste 160.

Although the invention has been described and illustrated in detail herein, it is to be clearly understood that the same is intended by way of illustration and example only, and is not intended to be taken by way of limitation. For example, in some implementations, the gripping handle means and flexible body element can be disposed in various alternative shapes and configurations. Thus, it is recognized that numerous other variations exist, including both narrowing and broadening variations of the appended claims.

What is claimed is:

1. An improved dental hygienic kit useful in the effective brushing of the teeth while materially avoiding irritation of the interior mouth surfaces, said kit comprising:

a measured quantity of toothpaste;

a flexible body element for storing and dispensing said measured quantity of toothpaste, and a removable toothbrush disposed within said flexible body element, said flexible body element comprising flexible walls, a closed bottom, and a substantially rigid, closable top including a flexible body sealing element for mating engagement with said toothbrush;

said removable toothbrush comprising grippable handle means disposed at the one end thereof for manually gripping and controlling use of said toothbrush, and a brush-bearing element comprising bristles disposed at the other end thereof and extending outwardly therefrom in a substantially single radial direction for operational use in the brushing of the teeth while materially avoiding engagement with the inner surface of the mouth, and a mating handle sealing element longitudinally disposed from said brush-bearing element on said removable toothbrush and disposed circumferentially therearound for mating engagement with said flexible body element sealing element, thereby convertibly to seal the toothpaste contents of said flexible body element from drying out, while providing access to said toothpaste contents upon removal therefrom of said toothbrush; and said flexible body element further comprising a diameter restrictor disposed internally of said flexible body sealing element for insertion within and withdrawal therefrom of said brush-bearing element to retain thereon a measured quantity of toothpaste.

2. The improved dental hygienic kit of claim 1, wherein said flexible body sealing element and said mating handle sealing element comprise operationally engageable male and female thread elements.

3. The improved dental hygienic kit of claim 1, wherein said flexible body element is elongated.

4. The improved dental hygienic kit of claim 1, wherein said flexible body element is substantially cylindrical in shape.

5. The improved dental hygienic kit of claim 4, wherein the closed bottom of said flexible body element comprises a substantially flat seal.

6. The improved dental hygienic kit of claim 1, wherein said flexible body element is rollable for use of substantially the entire toothpaste contents thereof.

7. The improved dental hygienic kit of claim 1, wherein said grippable handle means is substantially larger in diameter than the brush-bearing element.

8. The improved dental hygienic kit of claim 1, wherein said mating handle sealing element, comprises a grippable cap for said flexible body element and thereby is unitarily formed with said grippable handle means.

* * * * *